US008047400B1

(12) United States Patent
Luberto et al.

(10) Patent No.: US 8,047,400 B1
(45) Date of Patent: Nov. 1, 2011

(54) GRAVITY-FEED DISPLAY AND DISPENSING

(75) Inventors: Michael D. Luberto, Rivervale, NJ (US); Richard G. Schults, Glen Rock, NJ (US); Andrew B. Sholl, Cranbury, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 459 days.

(21) Appl. No.: 12/367,621

(22) Filed: Feb. 9, 2009

(51) Int. Cl.
*B65D 83/04* (2006.01)

(52) U.S. Cl. ..... 221/194; 221/82; 221/312 R

(58) Field of Classification Search ..... 221/193, 221/76, 82, 312 R, 194; 193/27, 32
See application file for complete search history.

(56) References Cited

U.S. PATENT DOCUMENTS

| | | | | |
|---|---|---|---|---|
| 2,239,030 | A | 4/1941 | Biddle | |
| 2,252,493 | A * | 8/1941 | Dennis | 221/152 |
| 3,286,846 | A | 11/1966 | Brandes | |
| 3,379,294 | A * | 4/1968 | Van Liew, Jr. | 193/2 R |
| 3,393,808 | A | 7/1968 | Chirchill | |
| 4,998,628 | A | 3/1991 | Ross | |
| 5,080,256 | A * | 1/1992 | Rockola | 221/109 |
| 5,108,005 | A * | 4/1992 | Mosbacher | 221/1 |
| 5,396,997 | A | 3/1995 | Johnson | |
| 5,553,736 | A * | 9/1996 | Healis | 221/62 |
| 6,206,237 | B1 * | 3/2001 | Dillon et al. | 221/289 |
| 7,918,365 | B2 * | 4/2011 | White et al. | 221/191 |
| 2002/0043509 | A1 | 4/2002 | Lajeunesse et al. | |

* cited by examiner

*Primary Examiner* — Patrick Mackey
(74) *Attorney, Agent, or Firm* — Arthur Jacob

(57) ABSTRACT

An improvement in a gravity-feed display and dispensing apparatus and method in which rolling articles are advanced by gravity along an upper chute from a loading location to a transition chute where the rolling articles are transferred to a lower chute located vertically below the upper chute, with a concomitant reversal of the direction of travel of the rolling articles, and then along the lower chute to a dispensing location. A plurality of retarding members are placed in position serially along the transition chute to engage a rolling article and bump the rolling article so as to gradually retard the speed of movement of the rolling article as the article traverses the transition chute, thereby limiting the magnitude of forces generated by the reversal of the direction of movement of the rolling article as the rolling article traverses the transition chute and avoiding excessive speed of movement of the rolling article upon arrival of the rolling article adjacent the dispensing location.

10 Claims, 3 Drawing Sheets

GRAVITY-FEED DISPLAY AND DISPENSING

The present invention relates generally to the display and dispensing of articles at a point-of-purchase and pertains, more specifically, to advancing rolling articles to a display and dispensing location by gravity feed from a loading location.

A very wide variety of display and dispensing arrangements currently are available for presenting articles at a point-of-purchase. In particular, rolling articles, such as cylindrical containers used in connection with the sale of foods and beverages, as well as a myriad of other products, very often are loaded into dispensers which feed the articles by gravity to a dispensing location at a point-of-purchase. In many instances, the containers are constructed of glass, or another frangible or easily damaged material, giving rise to the possibility of breakage, or at least some damage, as the articles travel from a loading location to the dispensing location.

Various arrangements have been suggested for retarding the speed of movement of rolling articles as the articles traverse a path of travel from the loading location to the dispensing location, thereby militating against breakage of or damage to a rolling article which otherwise could result from excessive speed along the path of travel. However, many of these arrangements are relatively complex, rendering such arrangements uneconomical for use in connection with the display and dispensing of less expensive, every-day items found at so many retail sales outlets.

The present invention provides for the display and dispensing of a wide variety of rolling articles in a gravity-feed display and dispensing arrangement with simplicity and economy so as to encourage widespread use in connection with a greater range of items offered at a point-of-purchase. As such, the present invention attains several objects and advantages. some of which are summarized as follows: Provides apparatus and method for displaying and dispensing rolling articles utilizing gravity feed to advance the articles from a loading location to a dispensing location while militating against breakage of or damage to the articles; resists damage to the dispensing apparatus itself, which damage otherwise could result from an excessive speed of movement of a rolling article as the article traverses a path of travel from a loading location to a dispensing location; provides a relatively simple construction, economically manufactured in large numbers for making available a gravity feed system for the display and dispensing of a wider variety of items at more sales outlets; is adapted readily to dispensing rolling articles of various dimensions and configurations utilizing a gravity feed system; enables greater safety and economy in a more versatile gravity feed arrangement for rolling articles; encourages the convenient use of gravity-feed display and dispensing for a wider variety of rolling articles with increased safety and economy; provides a gravity-feed display and dispensing arrangement capable of exemplary performance over an extended service life.

The above objects and advantages, as well as further objects and advantages, are attained by the present invention which may be described briefly as an improvement in a gravity-feed display and dispensing apparatus in which rolling articles, each having a generally circular profile configuration including a center of rotation and a predetermined diameter, are advanced by gravity in a first generally longitudinal direction along an upper chute from a loading location to a transition location where the rolling articles are transferred to a lower chute located vertically below the upper chute to advance by gravity in a second generally longitudinal direction, opposite to the first longitudinal direction, to a dispensing location, the apparatus including a transition chute at the transition location, the improvement including a retarding arrangement at the transition chute for retarding the speed of movement of a rolling article as the rolling article moves from the loading location to the dispensing location, the retarding arrangement comprising: a plurality of retarding members placed at the transition location in position serially along the transition chute to engage a rolling article, first above the center of rotation of the rolling article for directing the rolling article downwardly along the transition chute, then below the center of rotation so as to direct the engaged rolling article toward the second longitudinal direction, and then above the center of rotation so as to direct the engaged rolling article from the transition chute into the lower chute for advancement along the lower chute in the second longitudinal direction to the dispensing location; the serially positioned retarding members thereby gradually retarding the speed of movement of the rolling article through the transition chute to limit the magnitude of forces generated by reversal of the direction of movement of the rolling article and to avoid excessive speed of movement of the rolling article upon arrival of the rolling article adjacent the dispensing location.

In addition, the present invention provides a method for retarding the speed of movement of a rolling article in a gravity-feed display and dispensing apparatus in which rolling articles, each having a generally circular profile configuration including a center of rotation and a predetermined diameter are advanced by gravity in a first generally longitudinal direction along an upper chute from a loading location to a transition location where the rolling articles are transferred to a lower chute located vertically below the upper chute to advance by gravity in a second generally longitudinal direction, opposite to the first longitudinal direction, to a dispensing location, the apparatus including a transition chute at the transition location, the method including placing a plurality of retarding members at the transition location, in position serially along the transition chute to engage a rolling article, first above the center of rotation of the rolling article for directing the rolling article downwardly along the transition chute, then below the center of rotation so as to direct the engaged rolling article toward the second longitudinal direction, and then above the center of rotation so as to direct the engaged rolling article from the transition chute into the lower chute for advancement along the lower chute in the second longitudinal direction to the dispensing location and thereby gradually retard the speed of movement of the rolling article through the transition chute, thereby limit the magnitude of forces generated by reversal of the direction of movement of the rolling article, and avoid an excessive speed of movement of the rolling article upon arrival of the rolling article adjacent the dispensing location.

The invention will be understood more fully, while still further objects and advantages will become apparent, in the following detailed description of preferred embodiments of the invention illustrated in the accompanying drawing, in which.

Figure 1:
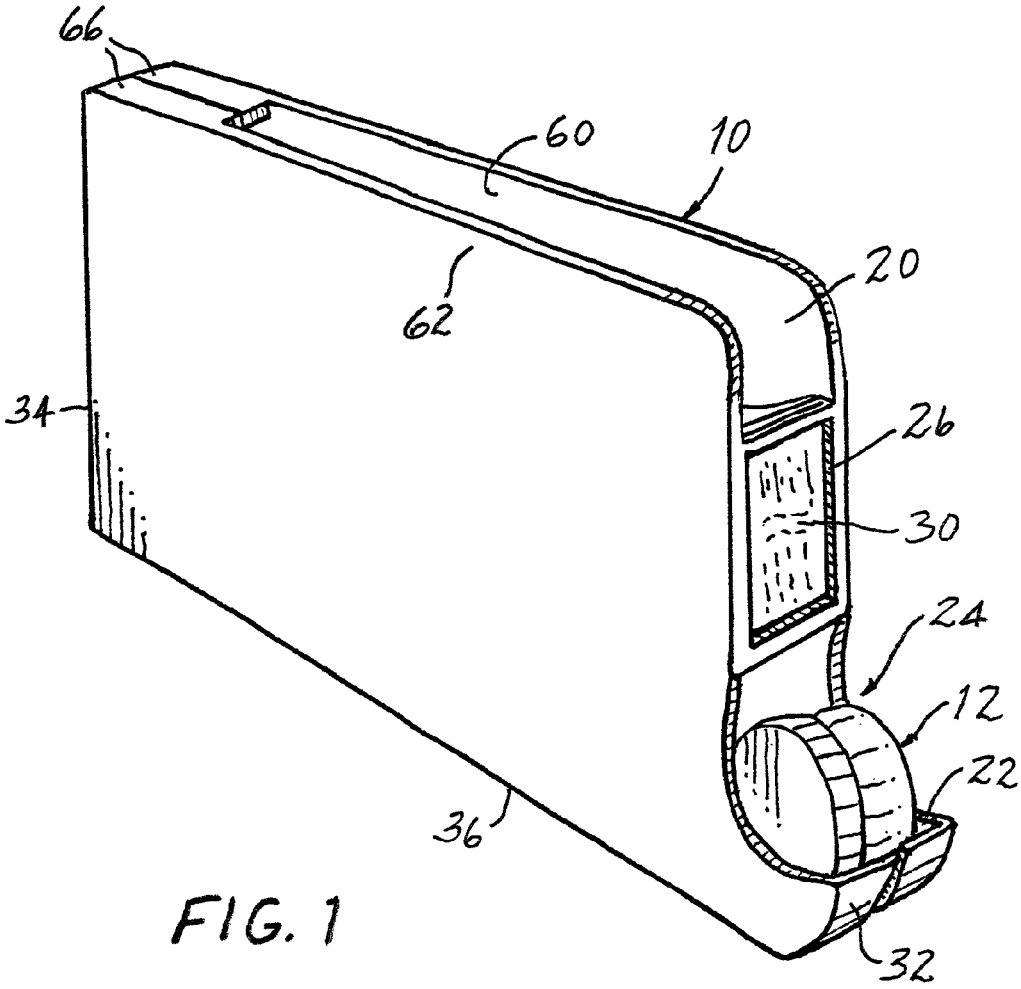
FIG. 1 is a pictorial perspective view of a display and dispensing apparatus constructed in accordance with the present invention.

Referring now to the drawing, and especially to FIG. 1 thereof, a gravity-feed display and dispensing apparatus constructed in accordance with the present invention is shown at 10 and is seen to be arranged to display and dispense rolling articles in the form of jars 12, in this instance containing baby food. Jars 12 have a cylindrical configuration and are loaded into apparatus 10 at a loading location 20 for presentation at a dispensing location 22 placed at a point-of-purchase 24. A card holder 26 at the point-of-purchase 24 holds a card 30 which bears graphic material identifying the contents of the jars 12 offered at the dispensing location 22.

Figure 2:
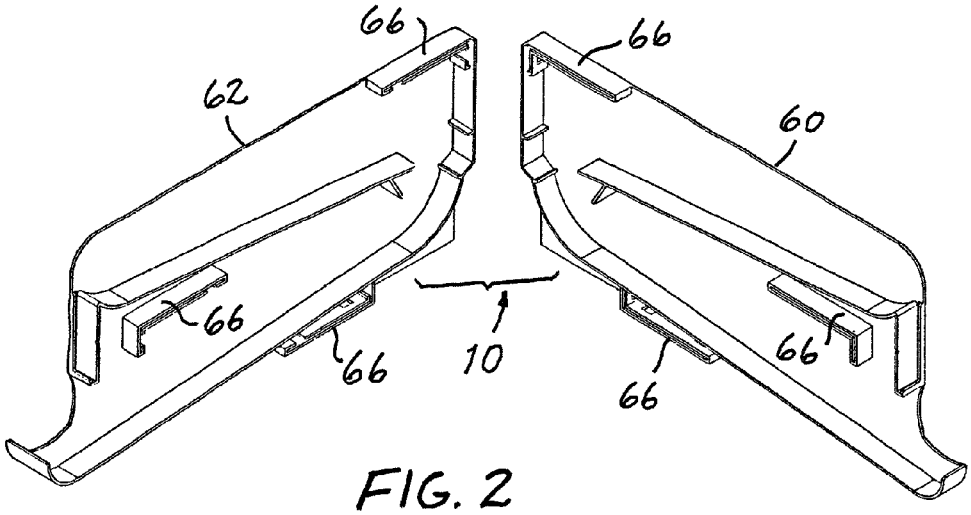
FIG. 2 is an exploded perspective view showing component parts of the apparatus of FIG. 1.
Figure 3:
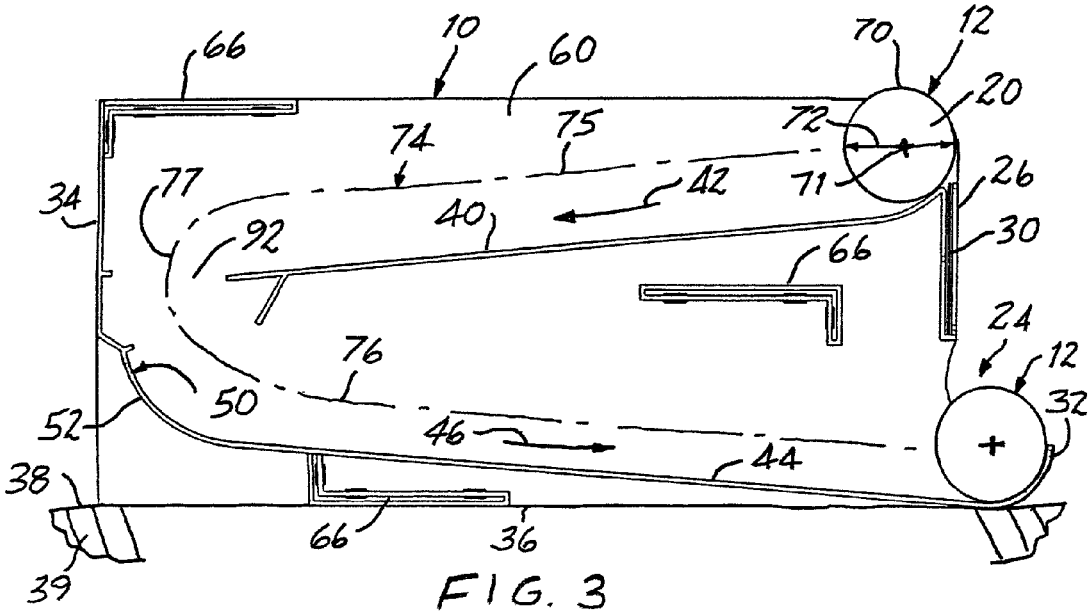
FIG. 3 is a somewhat diagrammatic side elevational view of one of the component parts.

Turning to FIGS. 2 and 3, as well as to FIG. 1, apparatus 10 includes a forward end 32 and a rearward end 34, and a horizontal basal surface 36. Ordinarily, apparatus 10 is placed upon a support surface, such as an upper surface 38 of a horizontal shelf 39 located at the point-of-purchase 24, with basal surface 36 resting upon upper surface 38. An upper chute 40 extends in a generally longitudinal first direction 42 from adjacent the forward end 32 toward the rearward end 34, and a lower chute 44 extends in a generally longitudinal second direction 46, essentially opposite to first direction 42, from adjacent the rearward end 34 toward the forward end 32, vertically below the upper chute 40, with the upper chute 40 and the lower chute 44 preferably being located generally in a common vertical plane, that is, the plane of the paper in the illustration of FIG. 3. A transition chute 50 is located adjacent the rearward end 34 of apparatus 10, at a transition location 52, and connects the upper chute 40 with the lower chute 44. In the preferred construction, apparatus 10 includes a right-side wall 60 and a left-side wall 62, each a generally mirror-image of the other and each molded of a synthetic polymeric material for being joined together to establish the apparatus 10. Respective connector elements 66, preferably molded unitary with each side wall 60 and 62, are joined together to secure side walls 60 and 62 in completed apparatus 10.

As best seen in FIG. 3, jars 12 include a generally circular profile configuration 70 having a center of rotation 71 and a predetermined diameter 72. Upper and lower chutes 40 and 44 are dimensioned and configured for receiving jars 12, and are tilted relative to basal surface 36 so that first and second directions 42 and 46 each progress slightly downwardly. The upper and lower chutes 40 and 44, together with transition chute 50, establish a serpentine path of travel 74 which includes a substantially straight upper leg 75 extending along the upper chute 40 between forward and rearward ends corresponding respectively to forward end 32 and rearward end 34, a substantially straight lower leg 76 extending along the lower chute 44 between forward and rearward ends corresponding respectively to forward end 32 and rearward end 34, and a transition leg 77 having a nominally curved configuration connecting the upper and lower legs 75 and 76. Thus, a jar 12 loaded into apparatus 10 at loading location 20 will roll along upper chute 40 in direction 42, biased by gravity, and then will pass through transition chute 50 to be transferred to lower chute 44 where jar 12 will continue to roll, still biased by gravity, now in direction 46, to arrive at dispensing location 24.

It has been found that, in the absence of any restraint, the speed of movement of a jar 12 along path of travel 74 from the loading location 20 to the dispensing location 24 can lead to deleterious consequences. Thus, a single jar 12, unfettered, can reach an excessive speed upon arrival at or near the dispensing location 24, where an abrupt stop could damage or even break the jar 12. If the speed is great enough, the jar 12 can jump from the apparatus 10, with an even more calamitous result. Should there be one or more other jars 12 along the path of travel 74, a collision at an excessive speed could result in breakage, or at least some damage, of one or more jars 12. Moreover, excessive speed of movement of a jar 12 in the transition chute 50, where the direction of travel of the jar 12 is reversed from direction 42 to direction 46, can generate forces tending to move the apparatus 10 itself if, as in some installations, the apparatus 10 merely is placed on a shelf or another support surface. Alternately, such generated forces can result in damage to the apparatus 10, especially in the vicinity of the transition chute 50. While adjusting the tilt of the upper and lower chutes 40 and 44 could maintain a slower speed of movement of a jar 12 as the jar 12 traverses the path of travel 74, such a measure can impede the effectiveness of the gravity feed system in delivering each consecutive jar 12 to dispensing location 24 as jars 12 are dispensed.

Figure 4:
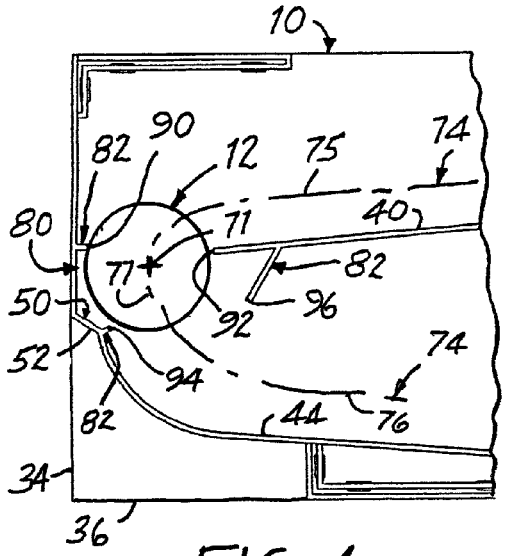
FIGS. 4 through 7 are fragmentary views of a portion of the component part shown in FIG. 3, diagrammatically illustrating the operation of the improvement of the present invention.
Figure 5:
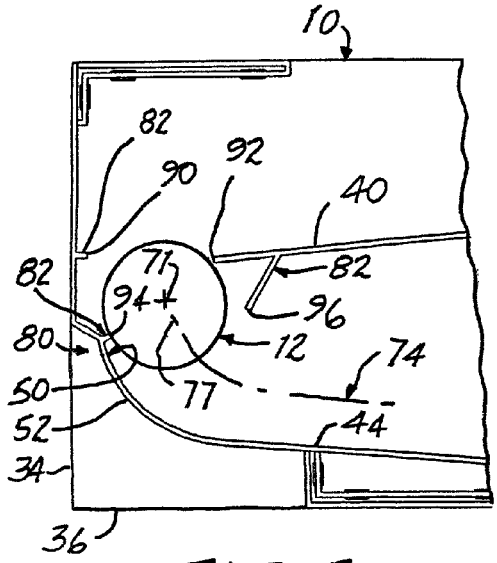
Figure 6:
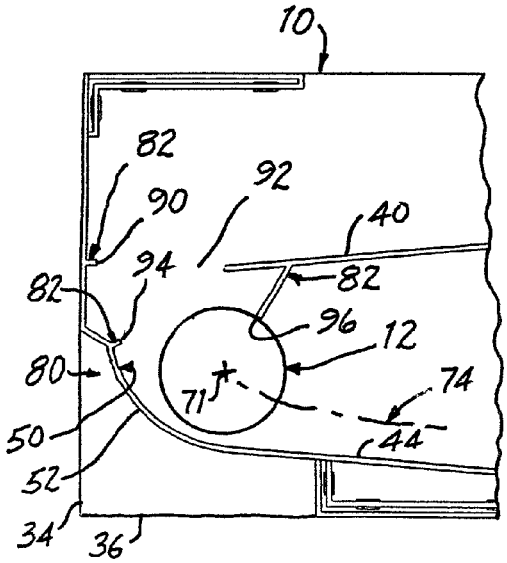
Figure 7:
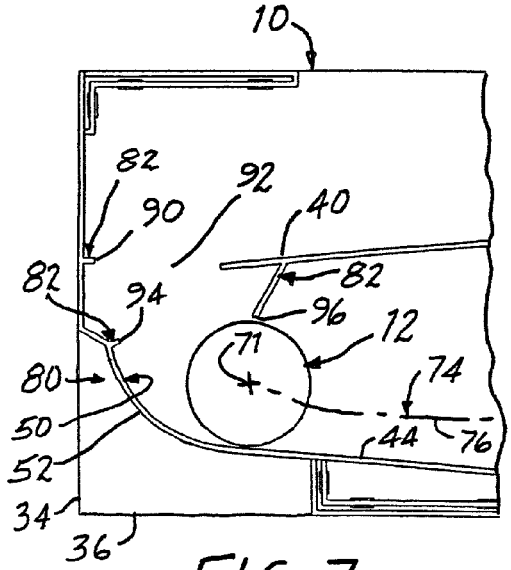

Referring now to FIGS. 4 through 7, as well as to FIG. 3, in order to militate against an excessive speed of movement of a jar 12 as the jar 12 traverses the path of travel 74, the present invention provides a speed retarding arrangement 80 at the transition location 52. Retarding arrangement 80 includes a plurality of retarding members in the form of bumpers 82 placed at the transition location 52 in position serially along the transition chute 50 to engage a jar 12 as the jar 12 passes through the transition chute 50. As seen in FIG. 4, a first bumper in the form of a first protrusion 90 is placed at the transition location 52 along path of travel 74 and is directed forward to establish a throat 92 at the entrance to transition chute 50, the throat 92 being generally complementary to the predetermined diameter 72 of the jar 12. Protrusion 90 is located in position to intercept a rolling jar 12 by engaging the jar 12 above the center of rotation 71 of jar 12 such that the jar 12 is directed by first protrusion 90 forward and slightly downward as the jar 12 passes through throat 92, while being slowed somewhat gently as the jar 12 passes through the throat 92 and progresses along the transition chute 50. The jar 12 then moves downwardly toward a second bumper in the form of second protrusion 94 directed forward into transition chute 50, below first protrusion 90. Second protrusion 94 then engages jar 12 below the center of rotation 71 of the jar 12, as seen in FIG. 5, so that the jar 12 is bumped forward, toward a third bumper in the form of a third protrusion 96. Third protrusion 96 is canted rearward and downward, forward of second protrusion 94, and engages jar 12 above the center of rotation 71, as seen in FIG. 6, so as to direct jar 12 rearwardly and downwardly into lower chute 44, as seen in FIG. 7. In this manner, the path of movement of the jar 12 along the transition chute 50 deviates slightly from the nominal curved configuration of the transition leg 77 of the path of travel 74 as the jar 12 traverses the transition chute 50 and is engaged sequentially by the serially placed protrusions 90, 94 and 96, so that the speed of movement of the jar 12 is retarded to assure that jar 12 will enter the lower chute 44 at a relatively slow speed, that is, a speed below that which could cause breakage or other damage, thereby avoiding deleterious consequences upon arrival of the jar 12 at or near dispensing location 24. In addition, the retarded speed of movement of jar 12 through the transition chute 50 limits the magnitude of forces generated by reversal of the direction of movement of the jar 12 as the jar 12 traverses the transition chute 50, thereby avoiding damage to the apparatus 10 itself.

In the preferred construction, each of the protuberances 90, 94 and 96 is molded unitary with the side walls 60 and 62 of the apparatus 10, and apparatus 20 is economically constructed of two relatively simple component parts, namely, side walls 60 and 62, readily assembled into a rugged construction for exemplary performance over an extended service life.

It will be seen that the present invention attains all of the objects and advantages summarized above, namely: Provides apparatus and method for displaying and dispensing rolling articles utilizing gravity feed to advance the articles from a loading location to a dispensing location while militating against breakage of or damage to the articles; resists damage to the dispensing apparatus itself, which damage otherwise could result from an excessive speed of movement of a rolling article as the article traverses a path of travel from a loading location to a dispensing location; provides a relatively simple construction, economically manufactured in large numbers for making available a gravity feed system for the display and dispensing of a wider variety of items at more sales outlets; is adapted readily to dispensing rolling articles of various dimensions and configurations utilizing a gravity feed system; enables greater safety and economy in a more versatile gravity feed arrangement for rolling articles; encourages the convenient use of gravity-feed display and dispensing for a wider variety of rolling articles with increased safety and economy; provides a gravity-feed display and dispensing arrangement capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in a gravity-feed display and dispensing apparatus in which rolling articles, each having a generally circular profile configuration including a center of rotation and a predetermined diameter, are advanced by gravity in a first generally longitudinal direction along an upper chute from a loading location to a transition location where the rolling articles are transferred to a lower chute located vertically below the upper chute to advance by gravity in a second generally longitudinal direction, opposite to the first longitudinal direction, to a dispensing location, the apparatus including a transition chute at the transition location, the improvement including a retarding arrangement at the transition chute for retarding the speed of movement of a rolling article as the rolling article moves from the loading location to the dispensing location, the retarding arrangement comprising:

a plurality of retarding members placed at the transition location in position serially along the transition chute to engage a rolling article, first above the center of rotation of the rolling article for directing the rolling article downwardly along the transition chute, then below the center of rotation so as to direct the engaged rolling article toward the second longitudinal direction, and then above the center of rotation so as to direct the engaged rolling article from the transition chute into the lower chute for advancement along the lower chute in the second longitudinal direction to the dispensing location;

the serially positioned retarding members thereby gradually retarding the speed of movement of the rolling article through the transition chute to limit the magnitude of forces generated by reversal of the direction of movement of the rolling article and to avoid excessive speed of movement of the rolling article upon arrival of the rolling article adjacent the dispensing location.

2. The improvement of claim 1 wherein the plurality of retarding members comprise:

a first bumper placed at the transition location in position to engage a rolling article, above the center of rotation of the rolling article for directing the rolling article downwardly along the transition chute and toward a second bumper;

the second bumper being placed at the transition location and below the first bumper, in position to engage the rolling article directed by the first bumper to the second bumper, below the center of rotation so as to direct the engaged rolling article toward the second longitudinal direction and into engagement with a third bumper;

the third bumper being placed at the transition location in position to engage the rolling article directed by the second bumper to the third bumper, above the center of rotation so as to direct the engaged rolling article from the transition chute into the lower chute for advancement along the lower chute in the second longitudinal direction to the dispensing location;

the first, second and third bumpers thereby gradually retarding the speed of movement of the rolling article through the transition chute to limit the magnitude of forces generated by reversal of the direction of movement of the rolling article and to avoid excessive speed of movement of the rolling article upon arrival of the rolling article adjacent the dispensing location.

3. The improvement of claim 2 wherein:

the upper chute, the lower chute and the transition chute define a serpentine path of travel along which the rolling articles move from the loading location to the dispensing location, the upper chute establishing an upper leg of the path of travel, the upper leg extending from an upper chute forward end rearwardly to an upper chute rearward end, the lower chute establishing a lower leg of the path of travel, the lower leg extending from a lower chute rearward end to a lower chute forward end, and the transition chute having a curved configuration for establishing a transition leg of the path of travel extending between the upper chute rearward end and the lower chute rearward end, the transition leg having a nominally curved configuration; and the bumpers are placed serially along the transition chute in position to intercept a rolling article traveling along the transition leg of the path of travel so as to bump the rolling article into deviations from the nominally curved configuration of the transition leg and thereby retard the speed of movement of the rolling article as the article traverses the transition leg, thus limiting the magnitude of forces generated by reversal of the direction of movement of the rolling article from the first longitudinal direction to the second longitudinal direction.

4. The improvement of claim 3 wherein the upper leg and the lower leg are located generally in a common vertical plane, with the upper leg placed vertically above the lower leg.

5. The improvement of claim 3 wherein the gravity-feed display and dispensing apparatus includes opposite side walls, the upper chute, the lower chute and the transition chute are integral with the side walls, and the bumpers comprise respective protrusions integral with the side walls and protruding into the transition leg of the path of travel.

6. The improvement of claim 5 wherein the upper chute, the lower chute and the transition chute are molded unitary with the side walls.

7. The improvement of claim 6 wherein the bumpers are molded unitary with the side walls.

8. The improvement of claim 3 wherein the first bumper comprises a first protrusion directed forward at the transition chute, the second bumper comprises a second protrusion directed forward into the transition chute, below the first protrusion, and the third bumper comprises a third protrusion canted rearward and downward, forward of the second protrusion, such that a rolling article will deviate from the nominally curved configuration of the transition leg of the path of travel as the rolling article is engaged sequentially by the serially placed bumpers thereby retarding the speed of movement of the rolling article as the rolling article traverses the transition leg of the path of travel.

9. A method for retarding the speed of movement of a rolling article in a gravity-feed display and dispensing apparatus in which rolling articles, each having a generally circular profile configuration including a center of rotation and a predetermined diameter are advanced by gravity in a first generally longitudinal direction along an upper chute from a loading location to a transition location where the rolling articles are transferred to a lower chute located vertically below the upper chute to advance by gravity in a second generally longitudinal direction, opposite to the first longitudinal direction, to a dispensing location, the apparatus including a transition chute at the transition location, the method including placing a plurality of retarding members at the transition location, in position serially along the transition chute to engage a rolling article, first above the center of rotation of the rolling article for directing the rolling article downwardly along the transition chute, then below the center of rotation so as to direct the engaged rolling article toward the second longitudinal direction, and then above the center of rotation so as to direct the engaged rolling article from the transition chute into the lower chute for advancement along the lower chute in the second longitudinal direction to the dispensing location and thereby gradually retard the speed of movement of the rolling article through the transition chute, thereby limit the magnitude of forces generated by reversal of the direction of movement of the rolling article, and avoid an excessive speed of movement of the rolling article upon arrival of the rolling article adjacent the dispensing location.

10. The method of claim 9 wherein the rolling article is moved along a serpentine path of travel from the loading location to the dispensing location, the path of travel including an upper leg extending along the upper chute, a lower leg extending along the lower chute and a nominally curved transition leg extending along the transition chute, and the rolling article is intercepted serially along the transition leg of the path of travel so as to bump the rolling article into deviations from the nominally curved configuration of the transition leg and thereby retard the speed of movement of the rolling article as the article traverses the transition leg, thus limiting the magnitude of forces generated by reversal of the direction of movement of the rolling article from the first longitudinal direction to the second longitudinal direction.

* * * * *